US007494029B2

(12) United States Patent
Orita

(10) Patent No.: US 7,494,029 B2
(45) Date of Patent: Feb. 24, 2009

(54) CONTAINER CARTRIDGE FOR BEVERAGE DISPENSER AND SUPPORT STRUCTURE THEREOF

(75) Inventor: Yoshinori Orita, Kakogawa (JP)

(73) Assignee: Kabushiki Kaisha Cosmo Life, Hyogo (JP)

( * ) Notice: Subject to any disclaimer, the term of this patent is extended or adjusted under 35 U.S.C. 154(b) by 441 days.

(21) Appl. No.: 11/224,092

(22) Filed: Sep. 13, 2005

(65) Prior Publication Data

US 2006/0071029 A1 Apr. 6, 2006

(30) Foreign Application Priority Data

Oct. 6, 2004 (JP) ..... 2004-293288
Nov. 8, 2004 (JP) ..... 2004-323549

(51) Int. Cl.
*B67D 5/06* (2006.01)
*B67D 5/62* (2006.01)

(52) U.S. Cl. ..... 222/105; 222/185.1; 222/146.6; 383/16; 383/80; 383/121.1; 220/495.03; 220/495.07; 141/114; 141/366

(58) Field of Classification Search ... 222/129.1–129.4, 222/181.1, 181.2, 185.1, 105, 181.3, 183, 222/80, 180, 107, 95, 96, 93, 146.6, 64, 325–327, 222/67, 215, 206; 141/114, 319, 321, 352, 141/363, 364, 365, 366; 383/16, 22, 23, 383/67, 80, 121.1; 220/592.03, 592.16, 592.17, 220/592.18, 592.2, 495.01, 495.03, 495.04, 220/495.07
See application file for complete search history.

(56) References Cited

U.S. PATENT DOCUMENTS 4,182,386 A * 1/1980 Alack ..... 141/83
4,232,803 A * 11/1980 Muller et al. ..... 222/105
4,597,102 A * 6/1986 Nattrass ..... 383/105
4,991,635 A * 2/1991 Ulm ..... 141/346
5,188,261 A 2/1993 Butters
5,307,955 A * 5/1994 Viegas ..... 222/107
5,361,941 A * 11/1994 Parekh et al. ..... 222/95
5,529,393 A * 6/1996 Polett ..... 383/24
5,638,989 A * 6/1997 Ophardt et al. ..... 222/105
5,746,339 A 5/1998 Petre et al.
6,098,844 A * 8/2000 Nicolle ..... 222/80
6,305,845 B1 * 10/2001 Navin ..... 383/67
6,398,073 B1 6/2002 Nicolle
6,648,180 B2 * 11/2003 Moon et al. ..... 222/185.1

(Continued)

FOREIGN PATENT DOCUMENTS

DE 34 36 053 4/1986

(Continued)

*Primary Examiner*—Kevin P Shaver
*Assistant Examiner*—Stephanie E Tyler
(74) *Attorney, Agent, or Firm*—Wenderoth, Lind & Ponack, L.L.P.

(57) ABSTRACT

A container cartridge for a beverage dispenser includes a bottom wall, a side wall and a top wall having a spout. The bottom wall, the side wall and the top wall, including the spout, are integrally formed of a polyethylene. The side wall is sufficiently thin so as to be foldable. Thus, after use, i.e. when the container cartridge has become empty, the container cartridge can be collapsed by folding the side wall. The thus collapsed container cartridge can be efficiently transported.

14 Claims, 9 Drawing Sheets

U.S. PATENT DOCUMENTS

| | | | | |
|---|---|---|---|---|
| 7,080,672 | B2 * | 7/2006 | Fournie et al. | 141/383 |
| 2003/0012586 | A1 | 1/2003 | Iwata et al. | |
| 2004/0079764 | A1 | 4/2004 | Balz et al. | |

FOREIGN PATENT DOCUMENTS

| | | | |
|---|---|---|---|
| EP | 0583953 | B1 | 8/1993 |
| EP | 0 893 358 | | 1/1999 |
| EP | 0 905 044 | | 3/1999 |
| EP | 0 905 046 | | 3/1999 |
| JP | 6-64660 | | 3/1994 |
| JP | 7-080916 | | 3/1995 |
| JP | 8-258894 | | 10/1996 |
| JP | 10-502038 | | 2/1998 |
| JP | 3066831 | | 12/1999 |
| JP | 3077225 | | 2/2001 |
| JP | 2002-302112 | | 10/2002 |

* cited by examiner

CONTAINER CARTRIDGE FOR BEVERAGE DISPENSER AND SUPPORT STRUCTURE THEREOF

BACKGROUND OF THE INVENTION

The present invention relates to a container cartridge for a beverage dispenser, and a support structure for the container cartridge.

Among known beverage dispenser systems, there is known one comprising a beverage (such as drinking water or juice) dispenser, and a container cartridge filled with beverage. The container cartridge includes a spout provided on its top through which beverage is introduced into and discharged from the container cartridge, and is set in the dispenser with its spout facing downward such that the spout is connected to an upwardly facing beverage supply port formed on the top surface of the dispenser.

Such a known container cartridge comprises a bottom wall, a side wall and a top wall on which the spout is provided. The bottom wall, side wall and top wall are all made of a synthetic resin and all have rigidity. After use, the container cartridge is recycled or discarded.

Since such a container cartridge has rigidity in its entirety, it remains bulky after use. Thus, such a cartridge cannot be efficiently transported for recycling or disposal.

An object of the present invention is to provide a container cartridge for a beverage dispenser which can be transported efficiently when it is empty.

SUMMARY OF THE INVENTION

According to the present invention, there is provided a container cartridge for use with a beverage dispenser, comprising a bottom wall, a side wall and a top wall formed with a spout through which beverage is adapted to be introduced into and discharged from the container cartridge, wherein the container cartridge is adapted to be set in the dispenser with the spout facing downward so that the spout is connected to an upwardly facing supply port of the dispenser, whereby beverage in the container cartridge is supplied into the dispenser, and wherein at least the side wall is sufficiently flexible so as to be collapsible.

Since at least the side wall is flexible, the used, empty container cartridge can be efficiently transported by collapsing it.

The bottom wall, side wall and top wall, including the spout, are preferably integrally formed of a common thermoplastic synthetic resin, the side wall being sufficiently thin so as to have flexibility. Such a container cartridge can be efficiently manufactured at a low cost.

Preferably, the container cartridge further comprises a carrying handle mounted to the bottom wall. With this arrangement, by carrying the cartridge by the handle, the spout faces downward. Then, simply by lowering the container cartridge onto the dispenser, the spout can be connected to the supply port of the beverage dispenser.

The bottom wall, including the spout, preferably has rigidity so that the spout will not be pushed out of the supply port of the dispenser when the spout is connected to the supply port.

The spout is preferably provided with an engaging portion for engaging a support member such that the container cartridge is hung from the support member with the spout facing upward. With this arrangement, the engaging portion stably keeps the spout in position while the side wall expands spontaneously under the weight of the beverage introduced into the container cartridge through the spout.

The engaging portion may be a flange or a groove formed around the spout.

Preferably, the bottom wall has rigidity, and is provided with a flange or a plurality of claws protruding outwardly of the side wall. The flange or the plurality of claws are brought into engagement with the top of a frame member surrounding the container cartridge to prevent the container cartridge from collapsing during use.

The present invention also provides a support structure for supporting the container cartridge for use with a beverage dispenser, wherein the support structure comprises a frame member supported on the beverage dispenser and surrounding the container cartridge such that the flange or the plurality of claws protruding from the edge of the bottom wall of the container cartridge are adapted to engage the top end of the support structure when the container cartridge is set in the dispenser. The support structure prevents deformation of the container cartridge during use.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

Figure 1:
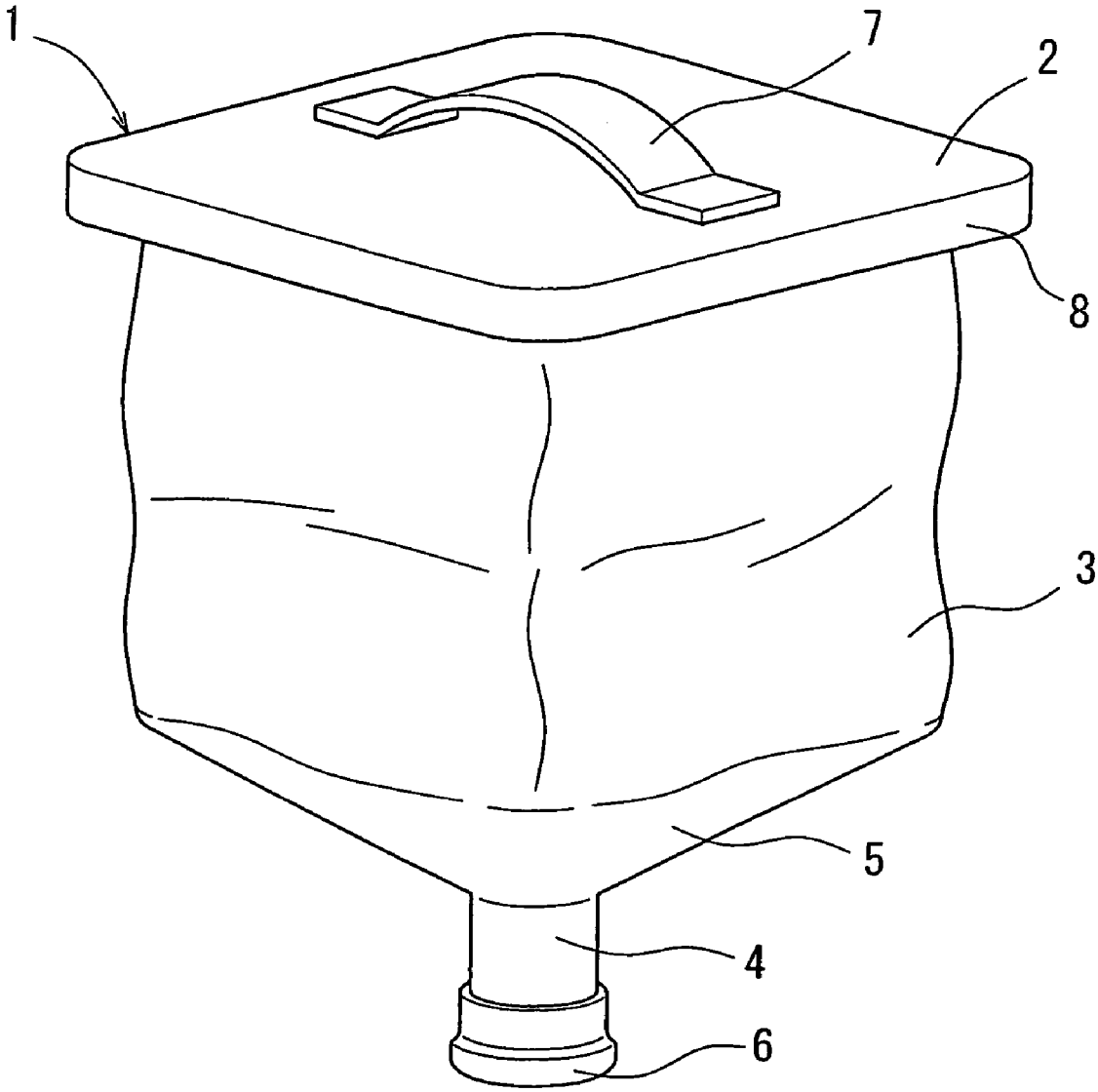
FIG. 1 is a perspective view of a container cartridge for a beverage dispenser embodying the present invention.
Figure 2:
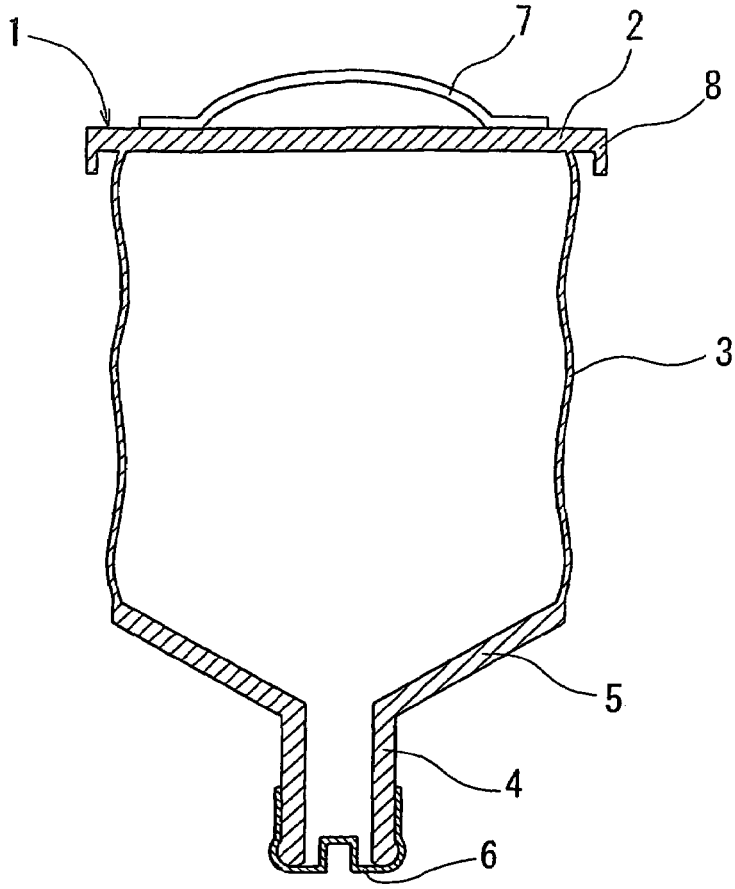
FIG. 2 is a vertical sectional view of FIG. 1.

Now referring to the drawings, FIGS. 1 to 6 show the first embodiment. As shown in FIGS. 1 and 2, the container cartridge 1 for a beverage dispenser of the first embodiment is a substantially box-shaped bottle including a bottom wall 2, a side wall 3 and a top wall 5 formed with a spout 4. The bottom wall 2, side wall 3 and top wall 5 are integrally formed of a polyethylene, i.e. a thermoplastic resin. A cap 6 is put on the spout 4 to keep a beverage such as drinking water or juice sealed in the container. The bottom wall 2 and the top wall 5, including the spout 4, have a sufficiently large thickness for rigidity. A carrying handle 7 is fastened to the bottom wall 2.

The bottom wall 2 has a flange 8 protruding outwardly of the side wall 3.

Figure 3:
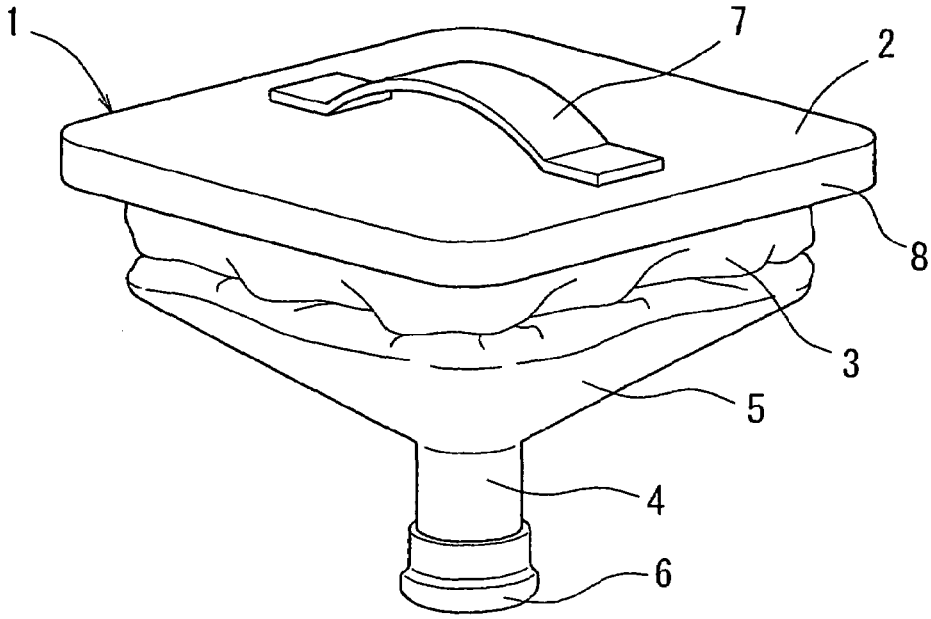
FIG. 3 is a perspective view of the container cartridge of FIG. 1, showing its collapsed state.

The side wall 3 is sufficiently thin so that when the cartridge becomes empty, it can be collapsed by folding the side wall as shown in FIG. 3. The thus collapsed cartridge can be easily and efficiently transported for recycling or disposal.

Figure 4:
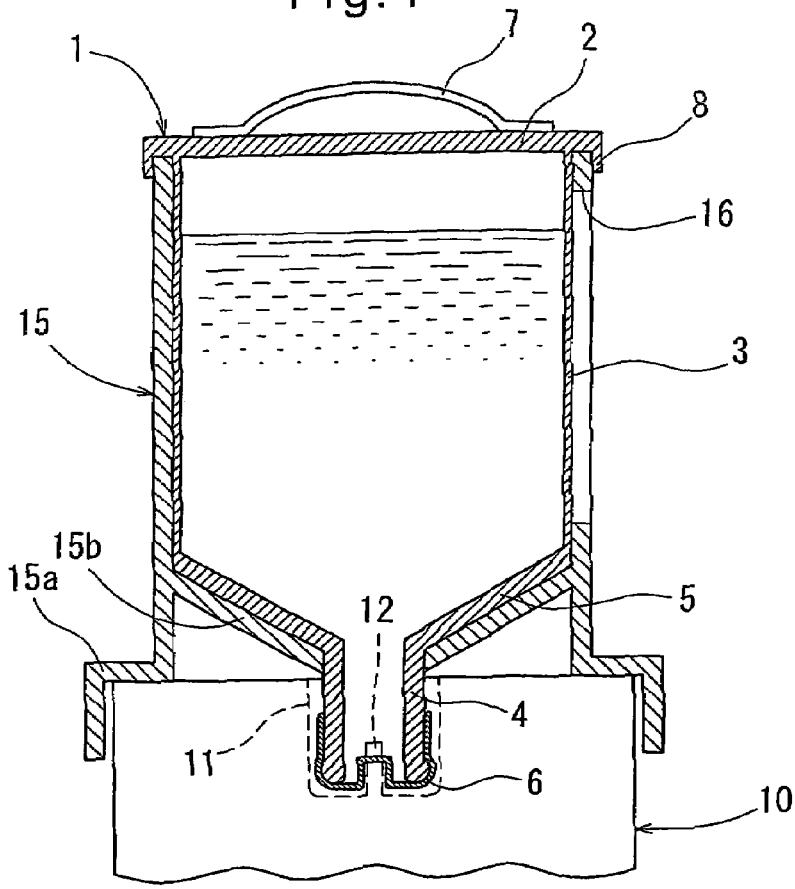
FIG. 4 is a sectional view of the container cartridge of FIG. 1, as mounted on a beverage dispenser.

FIG. 4 shows the container cartridge 1 as mounted in a beverage dispenser 10. The beverage dispenser 10 has a beverage supply port 11 in its top surface. A support structure 15 for the container cartridge 1 according to the present invention is supported on the dispenser 10 around the port 11 so as to enclose the dispenser 10.

Figure 5:
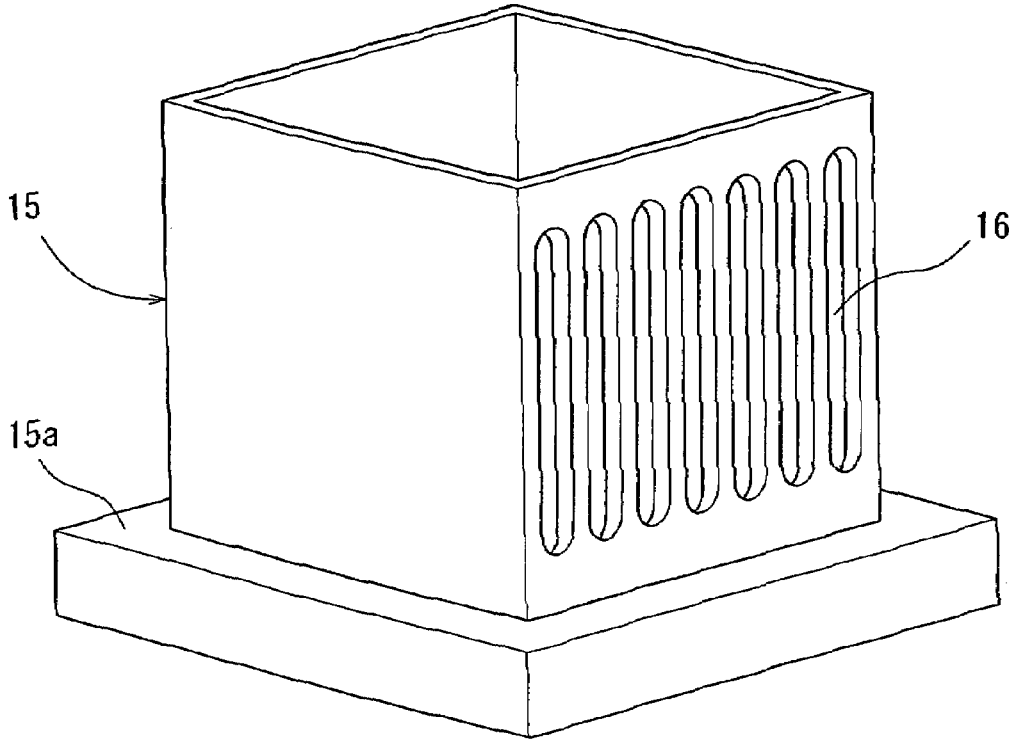
FIG. 5 is a perspective view of a container cartridge support structure according to the present invention.

As shown in FIGS. 4 and 5, the support structure 15 is a substantially box-shaped frame slightly greater in volume than the container cartridge 1, and includes a base 15*a* supported on the dispenser 10, and a cartridge support 15*b* for supporting the container cartridge. Vertical slits 16 are formed in one side of the body of the support structure 15 so that the level of the beverage in the container cartridge 1 set in the support structure 15 can be checked therethrough.

To set the container cartridge 1 in the beverage dispenser 10, with the cartridge 1 held by the handle 7 such that its spout 4 faces downward, the cartridge 1 is lowered with its side wall 3 slid along the side wall of the body of the support structure 15 until the spout 4 is received in and connected to the port 11 of the dispenser 10 and the flange 8 of the bottom wall 2 engages the top end of the support structure 15. Since the flange 8 is supported by the support structure 15, the container cartridge 1 will never be deformed even though its side wall 3 is flexible.

When the spout 4 of the container cartridge 1 is inserted into the supply port 11 of the dispenser 10, the tip of a conduit pipe 12 protruding into the supply port 11 from its bottom penetrates through the cap 6, so that the beverage in the cartridge 1 can flow into the pipe 12. The top wall 5, including the spout 4, is thick and rigid enough, however, so that when the pipe 12 penetrates through the cap 6, the spout 4 will not be pushed up by the pipe 12.

Figure 6:
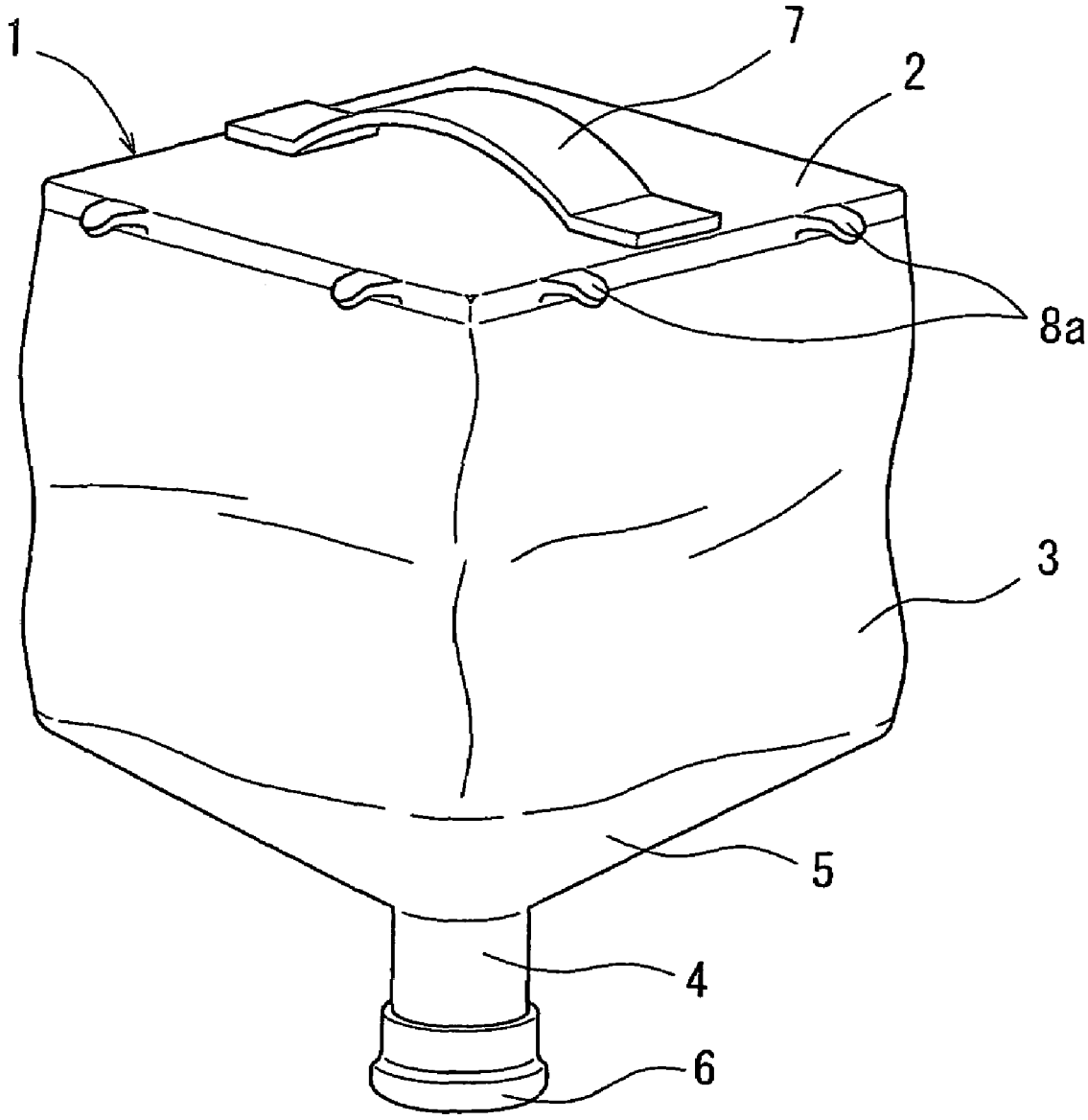
FIG. 6 is a perspective view of a modification of the container cartridge of FIG. 1.

FIG. 6 shows a modification of the container cartridge 1 of the first embodiment, in which the flange 8 is replaced with a plurality of claws 8*a* protruding outwardly from the edge of the bottom wall 2. Like the flange 8, the claws 8*a* are adapted to engage the top end of the support structure 15.

Figure 7A:
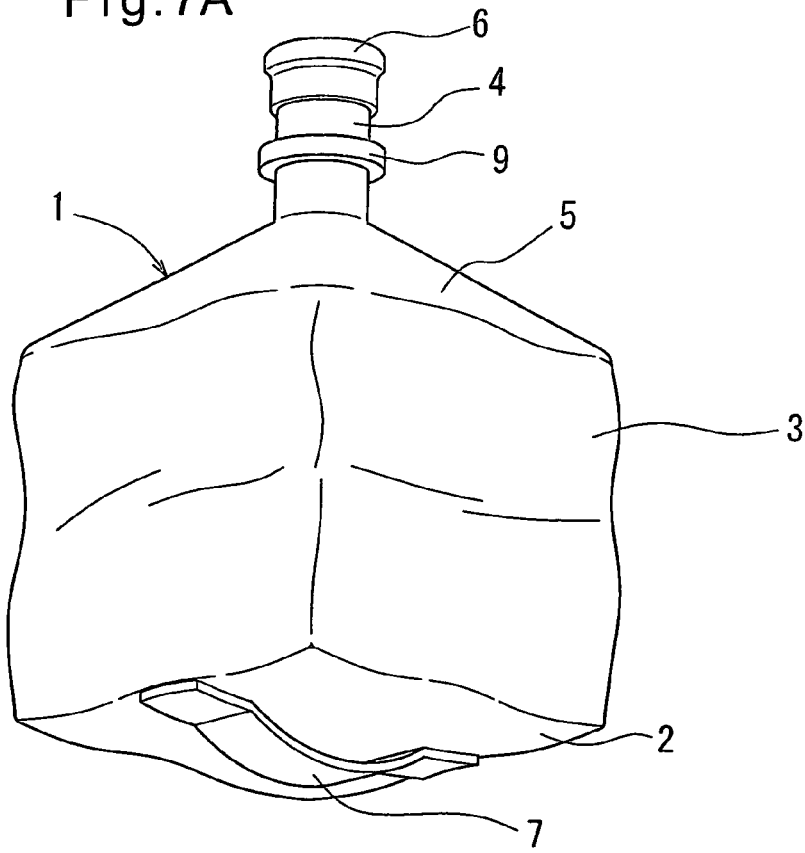
FIG. 7A is a perspective view of a container cartridge according to another embodiment of the invention.
Figure 7B:
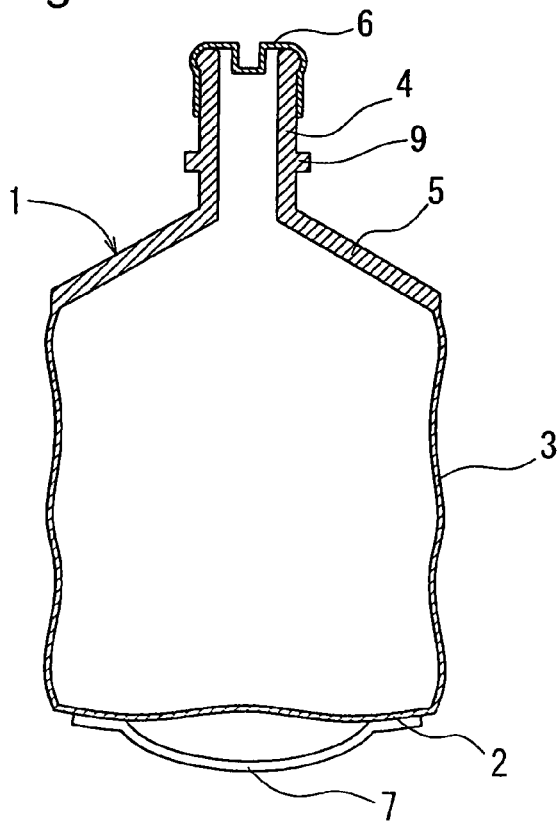
FIG. 7B is a vertical sectional view of FIG. 7A.

FIGS. 7A to 11 show the second embodiment. As shown in FIGS. 7A and 7B, the container cartridge 1 of the second embodiment is basically of the same structure as the container cartridge 1 of the first embodiment, and differs therefrom only in that the bottom wall 2 is thin, and in that a flange 9 is provided around the spout 4.

Figure 8:
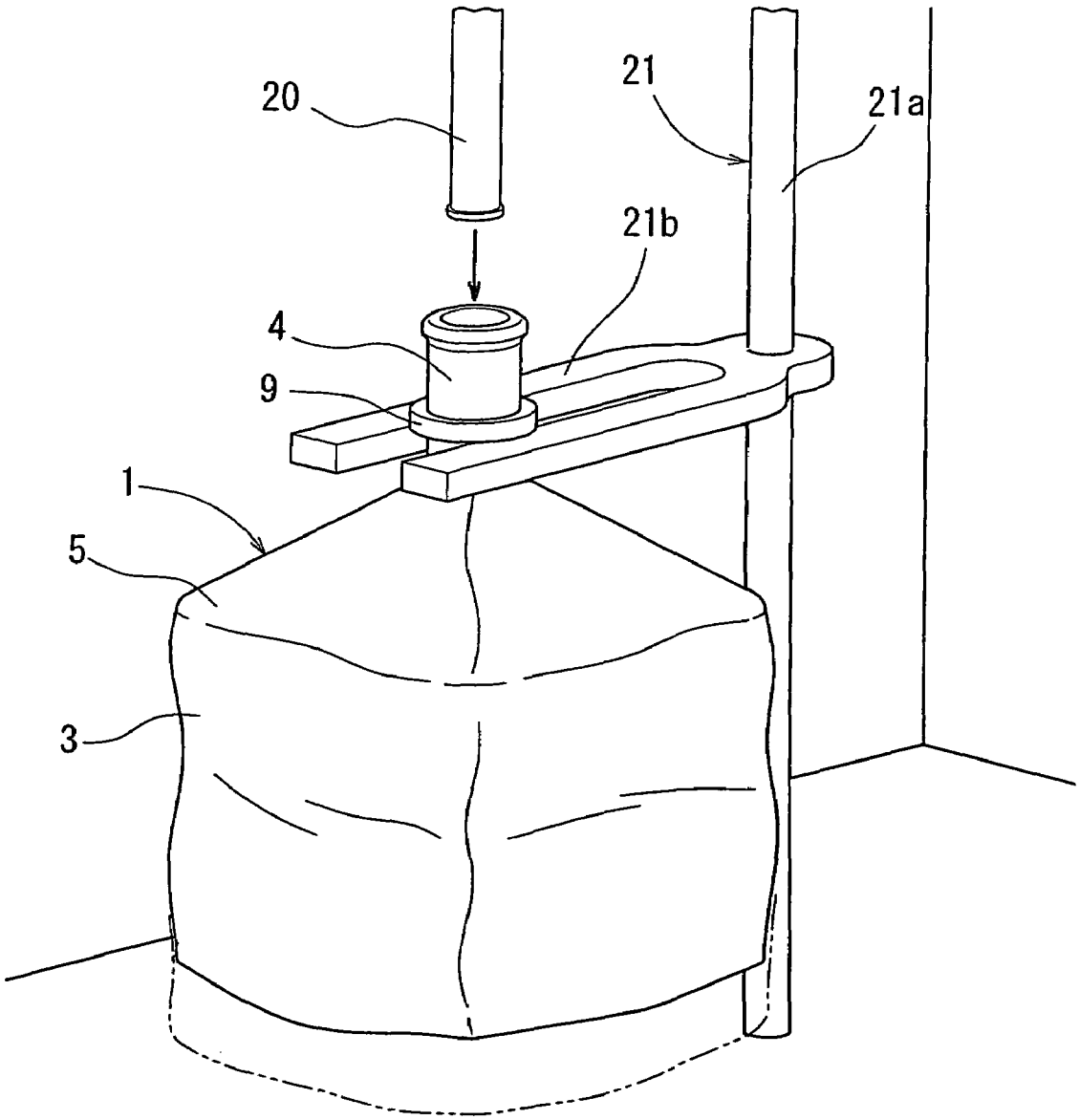
FIG. 8 is a perspective view of the container cartridge of FIGS. 7A and 7B, showing how beverage is introduced into the container cartridge.

As shown in FIG. 8, beverage is poured into the container cartridge 1 through a hose 20 with the flange 9 supported on a bifurcated engaging member 21*b* secured to a rod 21*a* of a support 21 such that the container cartridge 1 is hung from the bifurcated member 21*b*. With this arrangement, the spout 4 is stably fixed in position so as to be always located right under the outlet port of the hose 20. As the amount of beverage in the cartridge 1 increases, the side wall 3 will expand as shown by two-dot chain line under the weight of the beverage in the cartridge. Thus, beverage can be easily poured into the cartridge 1.

Figure 9:
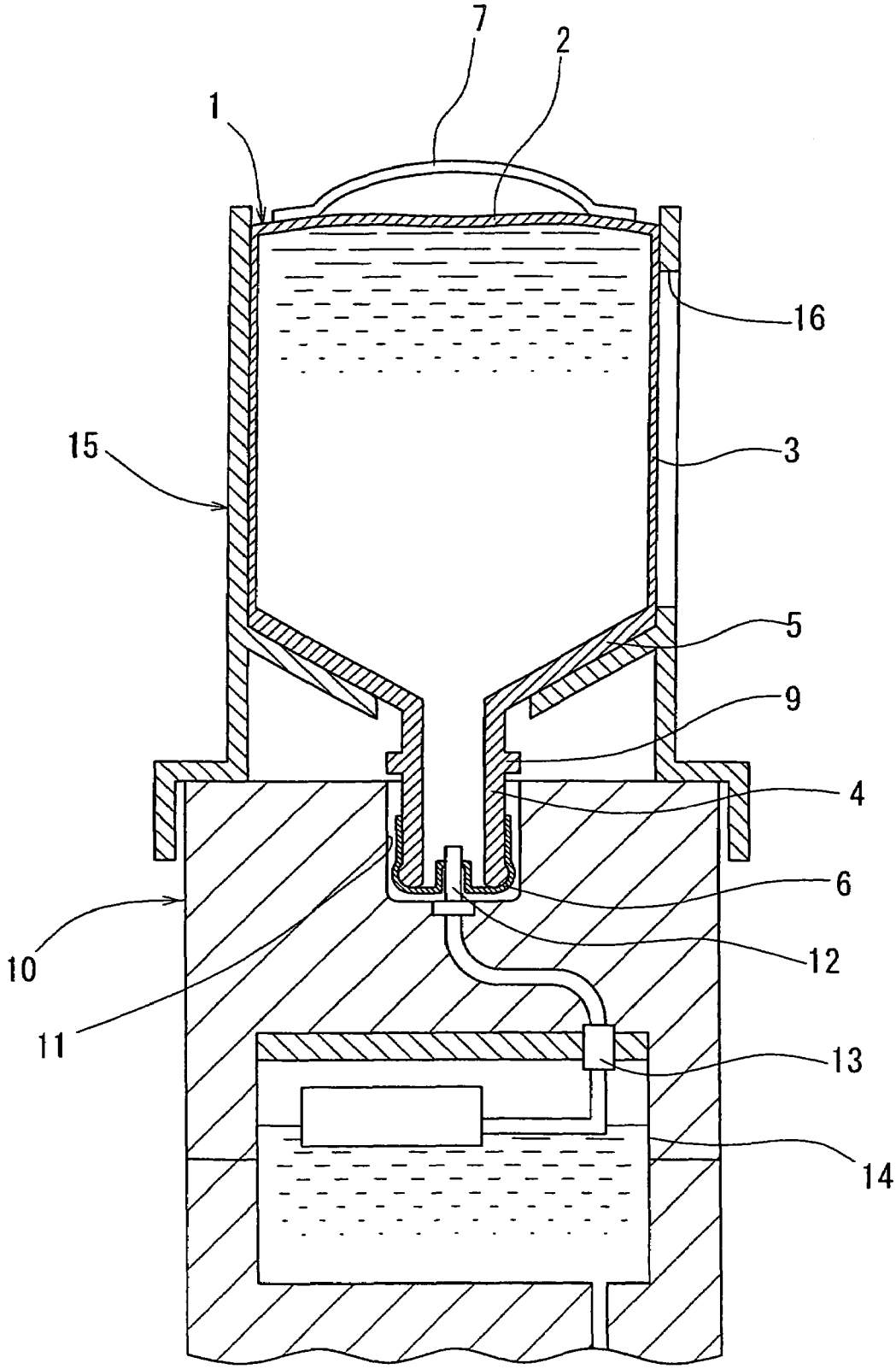
FIG. 9 is a sectional view of the container cartridge of FIGS. 7A and 7B, as mounted on a beverage dispenser.

FIG. 9 shows how the container cartridge 1 is set in a dispenser 10. As shown, the container cartridge 1 is set with its spout 4 facing downward so as to be connected to a supply port 11 formed in the top surface of the dispenser 10. When the spout 4 is inserted into the supply port 11, the tip of a conduit pipe 12 will penetrate through the cap 6. The support structure 15 supports the top wall 5 of the cartridge 1 around the spout 4, and surrounds its flexible side wall 3 to keep the side wall 3 from collapsing downward.

The conduit pipe 12 of the dispenser 10 is connected to a tank through a float valve 13 to keep the amount of beverage in the tank 14 to a predetermined level even though the flexible cartridge 1 is compressed under the atmospheric pressure. A vertical slit 16 is formed in one side of the body of the support structure 15 so that the level of the beverage in the container cartridge 1 set in the support structure 15 can be checked therethrough.

Figure 10:
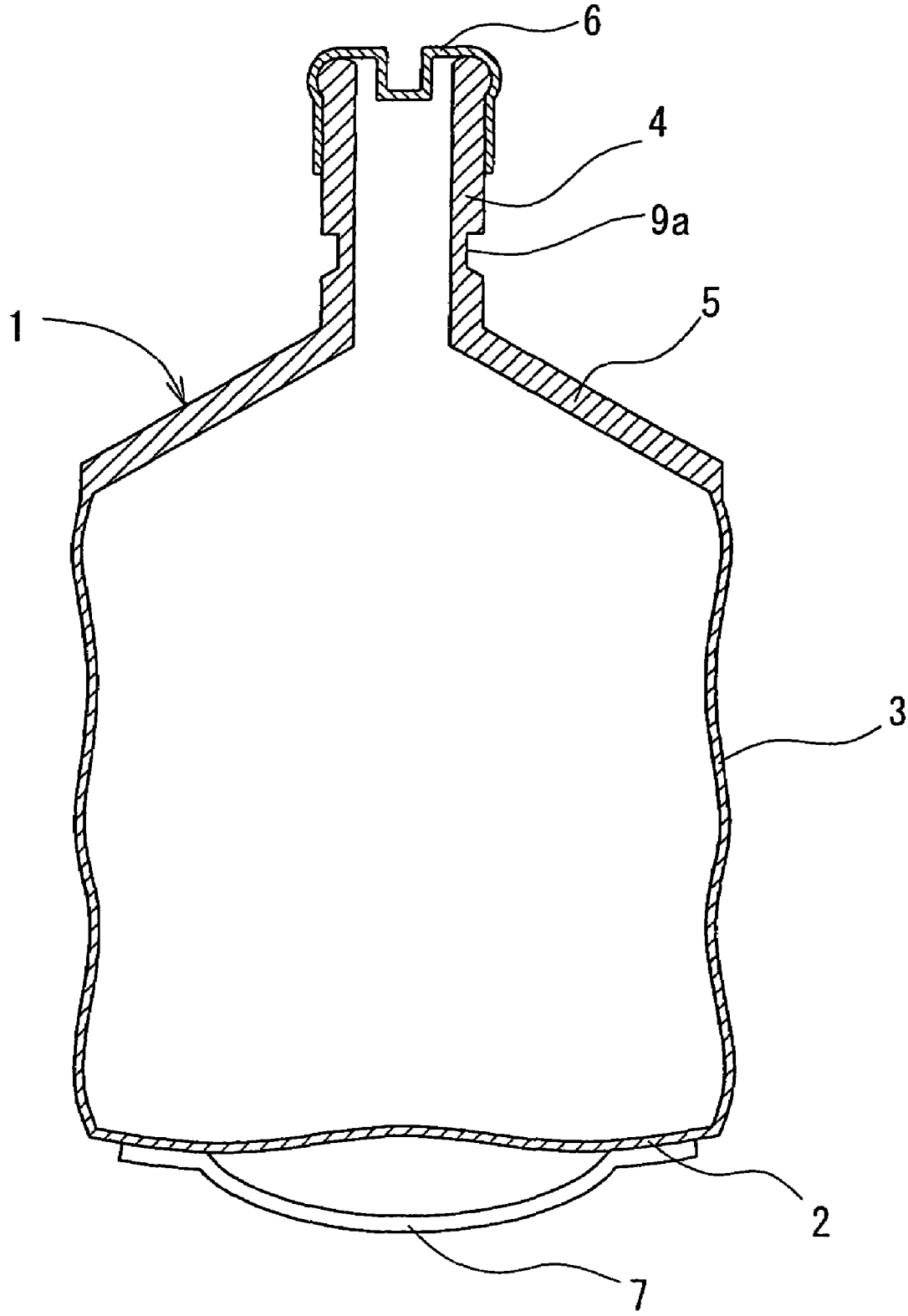
FIG. 10 is a perspective view of a modification of the container cartridge of FIGS. 7A and 7B.
Figure 11:
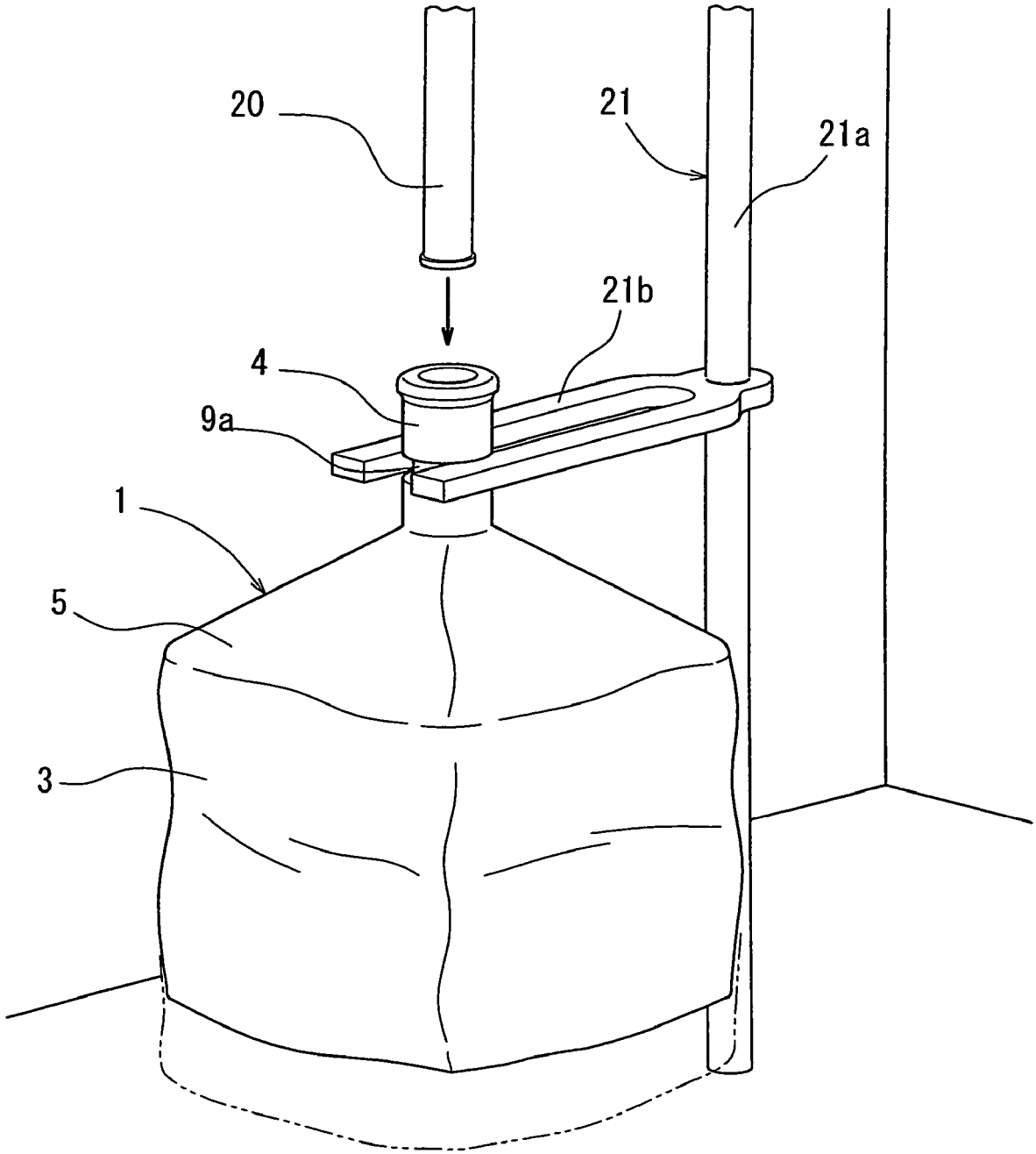
FIG. 11 is a perspective view of the container cartridge of FIG. 10, showing how beverage is introduced into the container cartridge.

FIG. 10 shows a modification of the second embodiment, in which instead of the flange 9, a groove 9*a* is formed around the spout 4. The groove 9*a* is defined by an upper wall perpendicular to the spout 4 and a radially outwardly inclined lower wall. In this arrangement, beverage is poured into the container cartridge 1 through a hose 20 with the bifurcated engaging member 21*b* of the support 21 inserted in the groove 9*a* from both sides of the spout 5 such that the container cartridge 1 is hung from the bifurcated member 21*b*. With this arrangement, too, the spout 4 is stably fixed in position so as to be always located right under the outlet port of the hose 20.

The container cartridge of either embodiment is a bottle having a square cross-section, and made of a polyethylene. But the cartridge according to the present invention is not limited to such a shape. For example, it may be a bottle having a round cross-section. Also, it may be made of a material other than a polyethylene.

What is claimed is:

1. A beverage dispenser system including a container cartridge, a beverage dispenser having an upwardly facing beverage supply port for connecting with said container cartridge, and a support structure having a top end and being configured to support said container cartridge, said container cartridge comprising:

a rigid bottom wall;

a flexible side wall connected to said rigid bottom wall;

a top wall connected to said flexible side wall;

wherein said rigid bottom wall, said flexible side wall and said top wall are together configured to define therewithin a beverage chamber to hold a beverage;

wherein said top wall has a spout formed therein through which beverage can be introduced into and discharged from said beverage chamber;

wherein said flexible side wall is sufficiently flexible so as to be collapsible;

wherein said rigid bottom wall, said flexible side wall and said top wall are together configured so that said container cartridge is adapted to be set in said support structure with said spout facing downward and with said spout connected to said upwardly facing supply port of said beverage dispenser;

wherein said rigid bottom wall is provided with one of a flange and a plurality of claws, said one of said flange and said plurality of claws protruding outwardly of said side wall and being configured to engage said top end of said support structure; and wherein said rigid bottom wall is sufficiently rigid to support said flexible side wall and said top wall when said one of said flange and said plurality of claws is engaged with said top end of said support structure, said side wall is depending downwardly from said rigid bottom wall, and said spout is connected to said upwardly facing supply port of said beverage dispenser.

2. The system of claim 1, wherein said bottom wall, said side wall and said top wall, including said spout, are integrally formed of a thermoplastic synthetic resin, said side wall being sufficiently thin to be sufficiently flexible to be collapsible.

3. The system of claim 1, further comprising a carrying handle mounted to said bottom wall.

4. The system of claim 1, further comprising a cap secured to said spout to cover an opening of said spout;

wherein said cap is configured to be penetrated by said upwardly facing supply port of said beverage dispenser when said one of said flange and said plurality of claws is engaged with said top end of said support structure, said side wall is depending downwardly from said rigid bottom wall, and said spout is connected to said upwardly facing supply port of said beverage dispenser.

5. The system of claim 4, wherein said top wall is sufficiently rigid so that said spout is not pushed up by said conduct pipe when said cap is penetrated by said conduct pipe.

6. The system of claim 1, wherein said one of said flange and said plurality of claws comprises said flange; and said flange extends about a periphery of said rigid bottom wall.

7. The system of claim 1, wherein said one of said flange and said plurality of claws comprises said plurality of claws; and said claws are spaced apart about a periphery of said rigid bottom wall.

8. The system of claim 1, wherein said container cartridge is disposed in said support structure such that said one of said flange and said plurality of claws is engaged with said top end of said support structure so that said container cartridge is supported with said flexible side wall depending downwardly from said rigid bottom wall, and said spout connected to said upwardly facing supply port of said beverage dispenser.

9. The system of claim 8, wherein said bottom wall, said side wall and said top wall, including said spout, are integrally formed of a thermoplastic synthetic resin, said side wall being sufficiently thin to be sufficiently flexible to be collapsible.

10. The system combination of claim 8, further comprising a carrying handle mounted to said bottom wall.

11. The system of claim 8, further comprising a cap secured to said spout to cover an opening of said spout;

wherein said cap is configured to be penetrated by a conduit pipe provided in said upwardly facing supply port of said beverage dispenser when said one of said flange and said plurality of claws is engaged with said top end of said support structure, said side wall is depending downwardly from said rigid bottom wall, and said spout is connected to said upwardly facing supply port of said beverage dispenser.

12. The system of claim 11, wherein said top wall is sufficiently rigid so that said spout is not pushed up by said conduit pipe when said cap is penetrated by said conduit pipe.

13. The system of claim 8, wherein said one of said flange and said plurality of claws comprises said flange; and said flange extends about a periphery of said rigid bottom wall.

14. The system of claim 8, wherein said one of said flange and said plurality of claws comprises said plurality of claws; and said claws are spaced apart about a periphery of said rigid bottom wall.

* * * * *